US010780406B2

(12) United States Patent
Grimm et al.

(10) Patent No.: US 10,780,406 B2
(45) Date of Patent: Sep. 22, 2020

(54) MIXING DEVICE WITH INTEGRATED DELIVERY PUMP

(71) Applicant: IKA-Werke GmbH & CO. KG, Staufen (DE)

(72) Inventors: Uwe Grimm, Bad Krozingen (DE); Philipp Gysler, Ehrenkirchen (DE); Jörg Gassenschmidt, Bad Krozingen (DE)

(73) Assignee: IKA-Werke GmbH & CO. KG, Staufen (DE)

( * ) Notice: Subject to any disclaimer, the term of this patent is extended or adjusted under 35 U.S.C. 154(b) by 111 days.

(21) Appl. No.: 15/547,683

(22) PCT Filed: Nov. 23, 2015

(86) PCT No.: PCT/DE2015/100498
§ 371 (c)(1),
(2) Date: Jul. 31, 2017

(87) PCT Pub. No.: WO2016/124164
PCT Pub. Date: Aug. 11, 2016

(65) Prior Publication Data

US 2018/0264419 A1 Sep. 20, 2018

(30) Foreign Application Priority Data

Feb. 4, 2015 (DE) ..... 10 2015 101 611
Apr. 7, 2015 (DE) ..... 10 2015 105 247

(51) Int. Cl.
*B01F 3/12* (2006.01)
*B01F 15/02* (2006.01)
(Continued)

(52) U.S. Cl.
CPC ..... *B01F 3/1221* (2013.01); *B01F 5/104* (2013.01); *B01F 7/00766* (2013.01); *B01F 15/00935* (2013.01); *B01F 15/0243* (2013.01)

(58) Field of Classification Search
CPC ..... B01F 3/1221; B01F 7/00766
(Continued)

(56) References Cited

U.S. PATENT DOCUMENTS 3,503,846 A 3/1970 Nardi
4,239,396 A * 12/1980 Arribau ..... B01F 5/225 366/170.3
2008/0144431 A1* 6/2008 Troxler ..... B01F 3/04602 366/164.1

FOREIGN PATENT DOCUMENTS

EP 1197260 A1 4/2002
EP 1674151 A1 6/2006
EP 2609998 A1 7/2013

OTHER PUBLICATIONS

International Search Report and Written Opinion of the International Searching Authority for PCT/DE2015/100498, dated Aug. 11, 2016.

* cited by examiner

*Primary Examiner* — Elizabeth Insler
(74) *Attorney, Agent, or Firm* — Budzyn IP Law, LLC

(57) ABSTRACT

The invention relates to a mixing device (1) for intermixing powder particles and/or granular particles, or a similar free-flowing solid with at least one liquid. The mixing device comprises a feed duct (5) for a solid, an inlet (17) for the liquid, at least one mixing implement (8) that is rotatable about an axis in a mixing chamber (7), and an outlet for the mixture. The device is characterised by a delivery pump (14) which is arranged between the inlet (17) and the mixing implement (8).

24 Claims, 9 Drawing Sheets

(51) Int. Cl.
*B01F 15/00* (2006.01)
*B01F 5/10* (2006.01)
*B01F 7/00* (2006.01)

(58) Field of Classification Search
USPC ..... 366/164.6
See application file for complete search history.

Figur 6
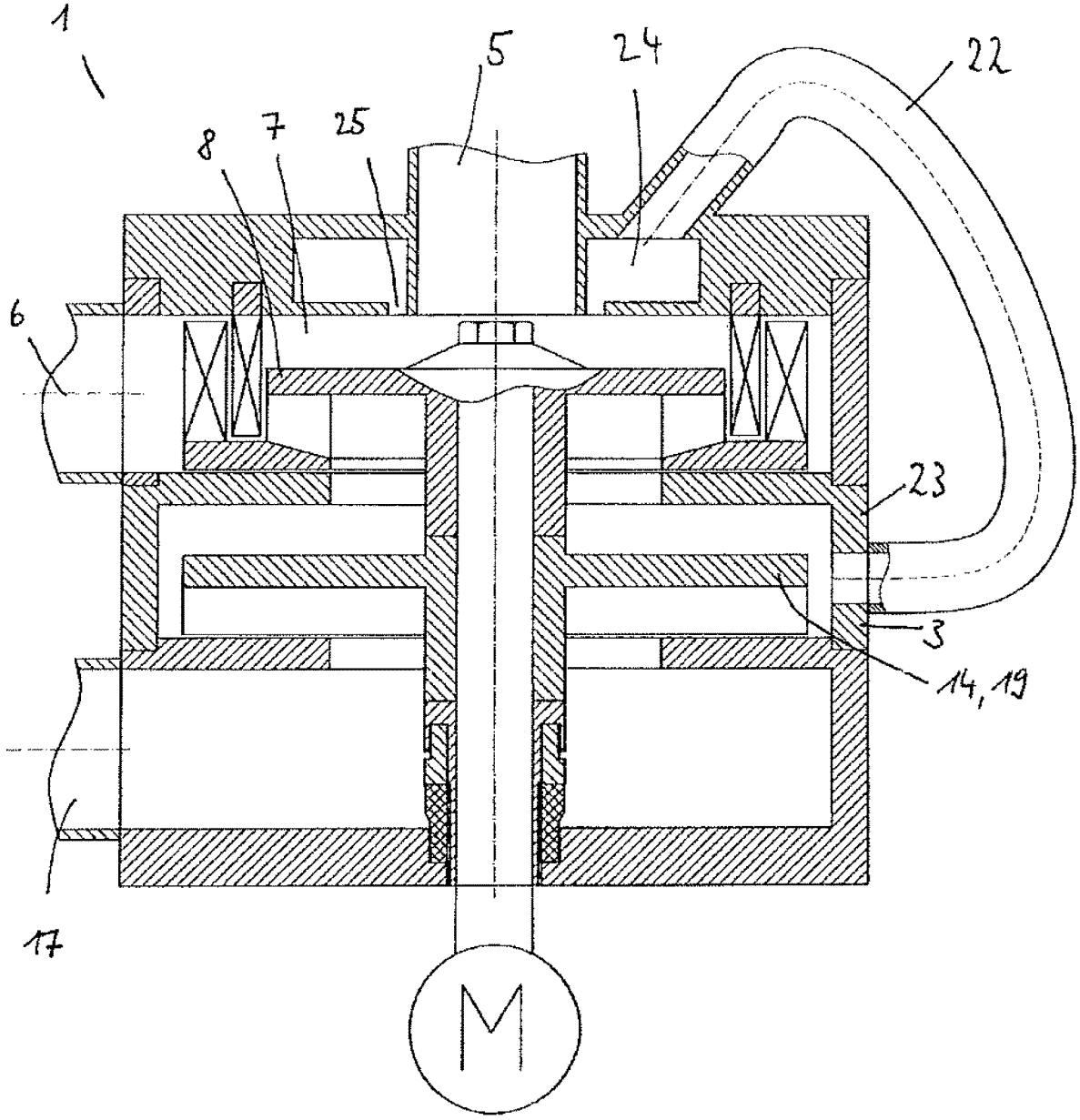

Figur 7
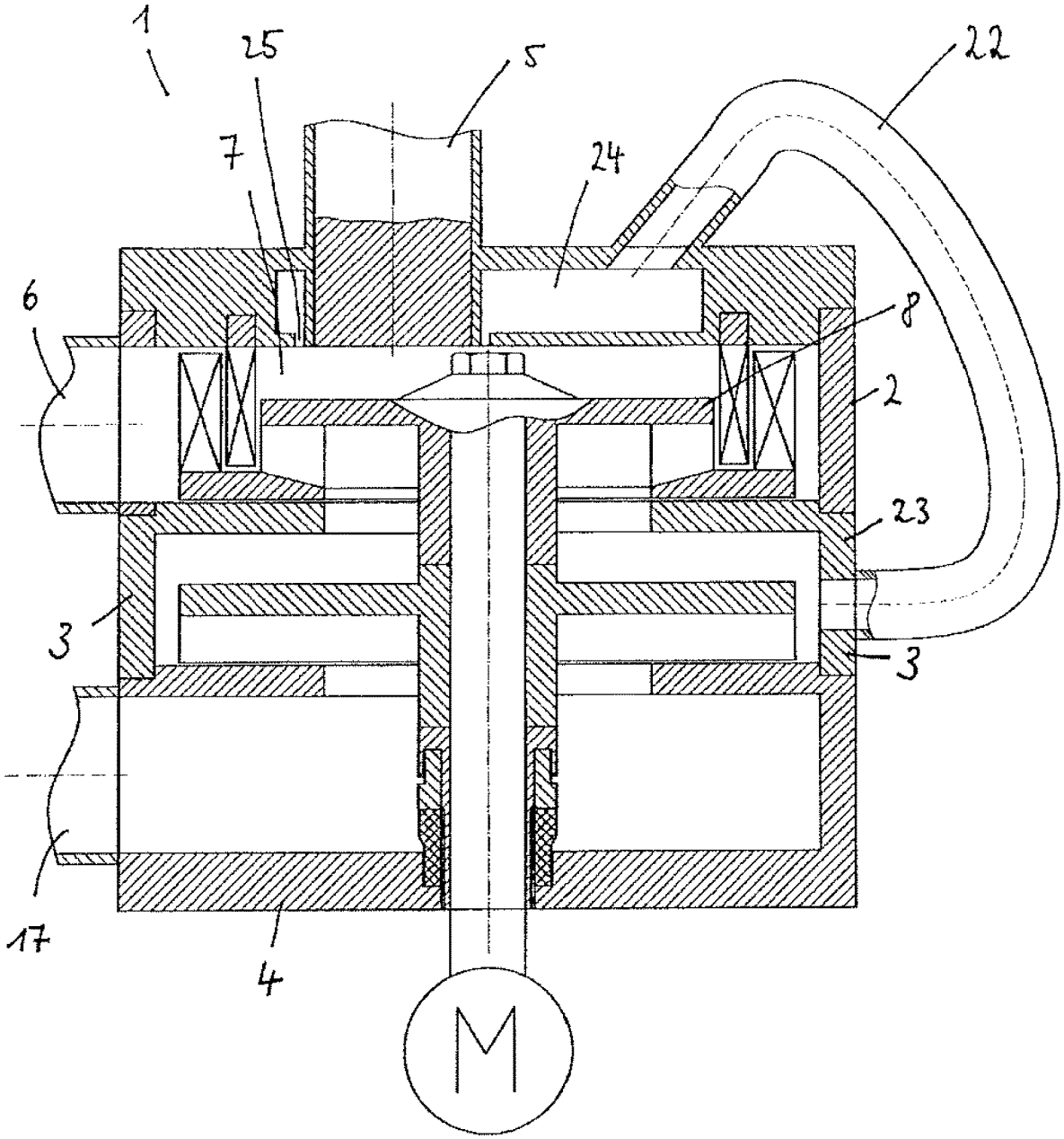

Figur 8
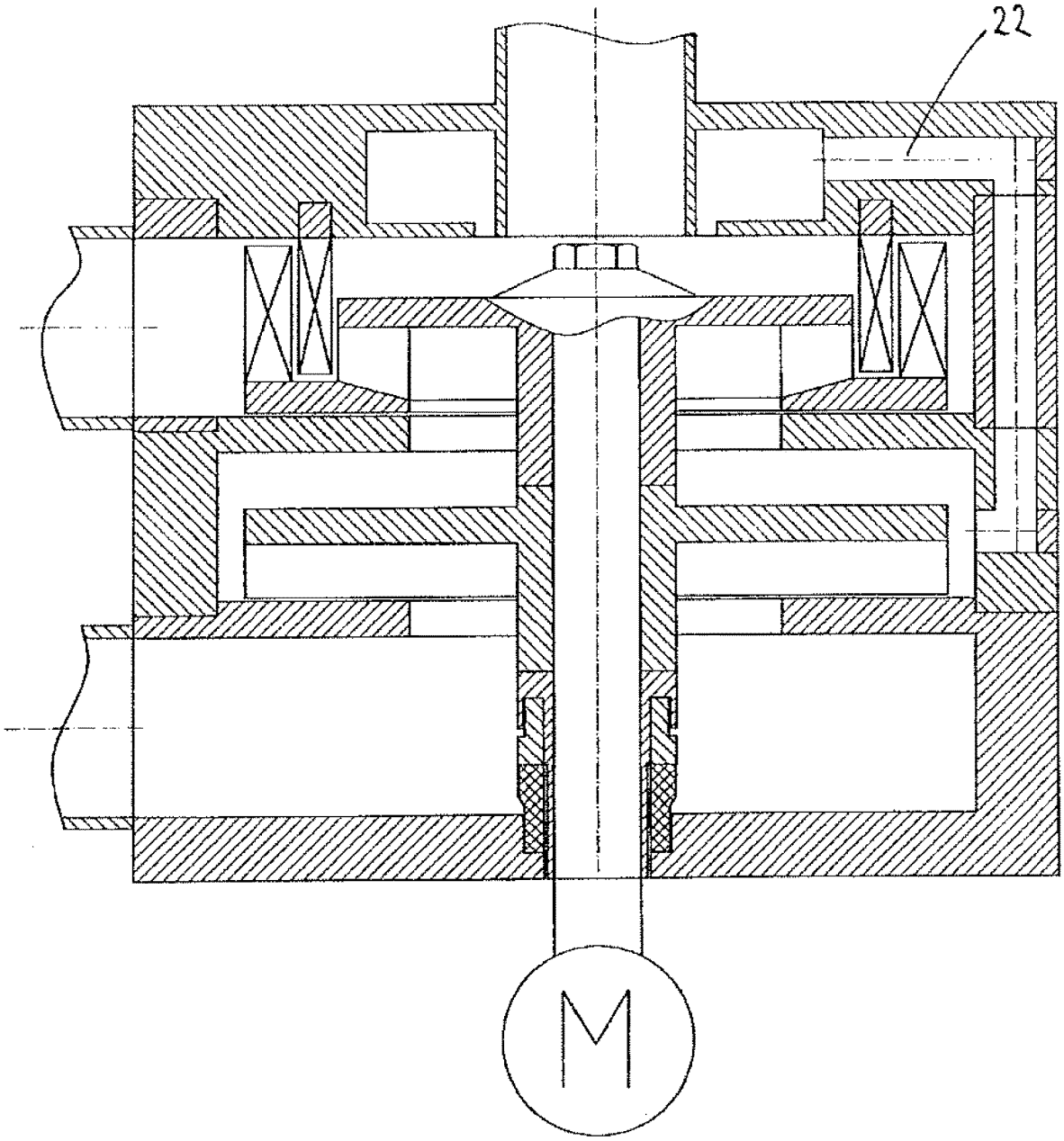

Figur 9
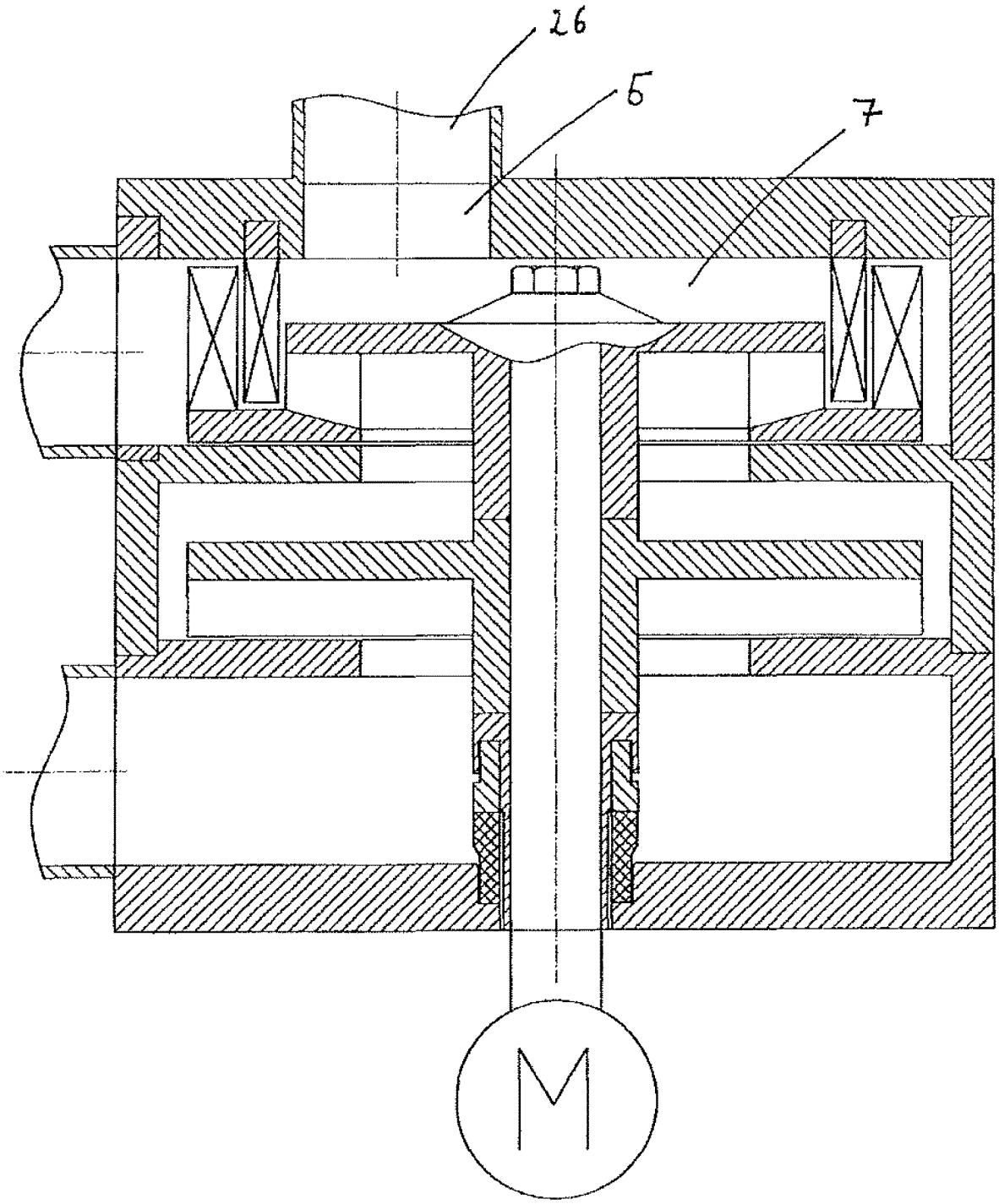

MIXING DEVICE WITH INTEGRATED DELIVERY PUMP

The invention at hand relates to a mixing device with an integrated delivery pump, and in particular to a mixing device for intermixing powder particles and/or granular particles or a similar free-flowing solid with at least one liquid, the mixing device comprising a feed duct for the solid, an inlet for the liquid, at least one mixing implement, which is rotatable about an axis in a mixing chamber, and an outlet for the mixture.

Such a mixing device is known from DE 19629945 A1 and serves the purpose of incorporating solids, such as powder, granulates and bulk goods into a liquid template. Solid and liquid are fed separately. During operation, a highly turbulent zone is created by rotating the mixing implement. A low pressure is created thereby, by means of which the solid and the liquid are sucked into the mixing chamber.

In the case of liquids with high viscosity, there is the danger that the suction effect is not sufficient in order to establish the desired liquid throughput.

In the case of high viscosity, the liquid throughput and thus the suction effect for the solid decrease in the feed duct. As the viscosity of the liquid increases, the device loses the ability to absorb solids. The same applies for mixtures, the viscosity of which increases during the course of the mixing process. This problem can be reduced by connecting an external pump, e.g. a displacement pump, which intensifies the suction effect and maintains the liquid throughput. This solution, however, is extensive with respect to construction.

There is thus the object of creating a device of the above-mentioned type, which can be constructed in a simple and compact manner and which is suitable to also process liquids with a high viscosity or mixtures with a variable viscosity.

This object is solved by means of the invention specified in claim 1. Advantageous embodiments are specified in the subclaims and in the following description.

According to the invention, a mixing device is created for intermixing powder particles and/or granular particles or a similar free-flowing solid with at least one liquid, the mixing device comprising a feed duct for the solid, an inlet for the liquid, at least one mixing implement, which is rotatable about an axis in a mixing chamber, an outlet for the mixture, and a delivery pump, which is arranged between the inlet and the mixing implement.

The invention at hand is based on the knowledge that an even, stable liquid throughput can be attained by means of the integrated delivery pump, even if liquids with high or increasing viscosity are processed. This is in particular advantageous, when the device has a return, i.e. when the mixture is guided back into the liquid container and is fed to a new processing again.

The liquid throughput in particular also remains stable, when the feed of the solid is released, e.g. by opening a valve, which is provided for this purpose, in the feed duct for the solid. In contrast, a "breakdown" of the suction effect and thus of the feed of the liquid and/or of the solid can occur at least temporarily in the case of common mixing devices.

The invention provides for the delivery pump to be arranged between the inlet and the mixing implement, thus to be arranged upstream of the mixing implement with respect to the delivery direction of the solid, and downstream from the inlet. The suction effect is thus improved, without impeding the feeding of solid into the mixing chamber or having to avoid this by means of constructive measures.

In one embodiment, the outlet and/or the inlet is arranged horizontally or laterally and/or the feed duct is arranged vertically and in particular centrally. The outlet is arranged above the inlet. The pump is thereby arranged downstream from the inlet and upstream of the outlet in feeding direction of the liquid. The geometric center of the cross section of the feed duct is aligned with the axis of rotation of the mixing implement.

In one embodiment of the invention, the feed duct is arranged vertically and eccentrically with respect to the axis of rotation of the mixing implement. The fed solid comes into contact with the mixing implement outside of the center of the mixing implement. The mixing process thus takes place in a zone with a higher circumferential speed and on/at the mixing implement. The mixture is subjected to higher turbulences in this area of the mixing implement.

In one embodiment of the invention, the feed duct can be closed by means of a seal or a plug or a pressure piston, wherein the seal or the plug or the pressure piston can be moved in the feed duct along the feed direction of the solid and is flush with the walls of the feed duct. An intermixing of a certain amount of liquid with a certain amount of solid is possible without adding unwanted mass flows, in particular air or solid or liquid. This embodiment has the advantage that the walls of the feed duct remain clean and do not need to be cleaned additionally. Deposits are avoided. The seal can also be embodied for a simple sealing.

In one embodiment of the invention, a further connection exists between the delivery pump and the mixing chamber, wherein the further connection is formed by a pipe or a line on the outside of a housing of the mixing device, and has an opening into the mixing chamber. The further connection forms a bypass line for the liquid between the delivery stage and the mixing chamber. A portion of the delivered liquid reaches into the mixing chamber via an opening. The solid is thus brought into contact with the liquid from a plurality of sides. The liquid is thus distributed more evenly in the mixing chamber. Local overconcentrations or underconcentrations of solid are reduced.

In one embodiment of the invention, the further connection is arranged inside the housing of the mixing device, the further connection is in particular a connecting channel, which is embodied in the housing. Further lines, which run along the outside, can be forgone. Leakiness at the exterior lines and the risk of damages can be avoided. This embodiment further has the advantage that the design of the mixing device can be kept to be highly compact.

In one embodiment of the invention, the opening of the further connection is formed by an annular gap and/or at least one bore and/or at least one nozzle. Depending on the arrangement or intended use of the mixing device, different types of the opening can be provided. Different mixtures, which require different types of wetting, can thus be processed. In the particularly advantageous embodiment of the opening as annular gap, the liquid can be introduced into the mixing chamber in the form of a liquid curtain. This improves the wetting of the fed solid in a transition area between the solid and the liquid. Local overconcentrations of solid are avoided by means of the improved wetting. The formation of residues by the bonding and/or adhering of insufficiently wetted solids is prevented. The formation of clumps is avoided. A local overheating of fed solid is also prevented by means of the additional feeding of liquid. This can occur when the insufficient liquid feed creates local overconcentrations of solid, which can be subjected to high temperatures due to friction with the mixing implement. The mixing chamber can furthermore be rinsed with cleaning fluid in a simple and efficient manner. It is thus no longer necessary to open the mixing device in order to clean it (so-called "cleaning-in-place" characteristic).

In one embodiment of the invention, the annular gap is arranged above the mixing chamber with respect to the delivery direction of the liquid, in particular around the feed duct. The arrangement of the annular gap "on the ceiling" of the mixing chamber has the advantage that the fed liquid can run into the mixing chamber with the aid of gravity and forms a liquid curtain. The wetted surface of the liquid is increased, whereby the solid is wetted more quickly. This contributes to the improved dispersion. The arrangement of the annular gap around the feed duct ensures an even liquid distribution. The fed solid is wetted evenly. This prevents clumping as a result of local liquid deficiency.

In one embodiment, the delivery pump is formed by a centrifugal pump comprising a delivery wheel comprising a plurality of conveying vanes, in particular four or eight preferably curved conveying vanes. Such a delivery pump can be realized in a structurally simple manner, so that existing constructions can be upgraded with relatively little effort.

In an alternative embodiment, the delivery pump is formed by a rotor-stator device comprising one or a plurality of rotor and/or stator rims in concentric arrangement. Possible agglomerates in the mixture are comminuted by means of this embodiment and an additional fine dispersion of the mixture is attained. This is in particular the case when the mixture recirculates, i.e. is fed to the mixing process again.

In one embodiment, the conveying vanes or rotor and/or stator rims are arranged on the side of the delivery pump facing away from the mixing implement. Such an arrangement has a particularly good suction effect.

In one embodiment, the delivery pump is arranged on the same drive shaft as the mixing implement. Only a single drive motor is thus required for the mixing implement and the delivery pump.

In one embodiment, the outlet empties into an outline line, which leads back into a container for the liquid, which is connected to the liquid feed via a feed line. It is thus possible for the starting material from the container to gradually intermix more and more with the solid and to be delivered back again and again, until a desired total mixture is created, which has a corresponding degree of homogeneity and/or viscosity.

In an advantageous embodiment, the mixing device is embodied in a modular manner, with a mixing module comprising the mixing implement, a delivery module comprising the delivery pump, and an inlet module comprising the inlet, wherein the delivery module can be arranged between the mixing module and the inlet module, and the inlet module can be arranged directly on the mixing module. According to this embodiment, it is possible to provide individual modules and to combine them with one another or to omit them. The delivery pump can for example not be required for the processing of a liquid with a low viscosity. It is possible in this case to remove the delivery module and to directly connect the mixing module to the inlet module. If a liquid with a high viscosity is to be processed by means of the mixing device, the delivery module can be added (subsequently).

Exemplary embodiments of the invention will be described in more detail below by means of the drawings. In partly schematized illustration:

FIG. 6 shows a mixing device according to a further embodiment of the invention comprising a bypass line in cross section;

FIG. 7 shows a mixing device according to an embodiment of the invention comprising an eccentric feed duct in cross section;

FIG. 8 shows a mixing device according to a further embodiment of the invention comprising an internal bypass line in cross section; and FIG. 9 shows a mixing device according to a further embodiment of the invention in cross section.

Figure 1:
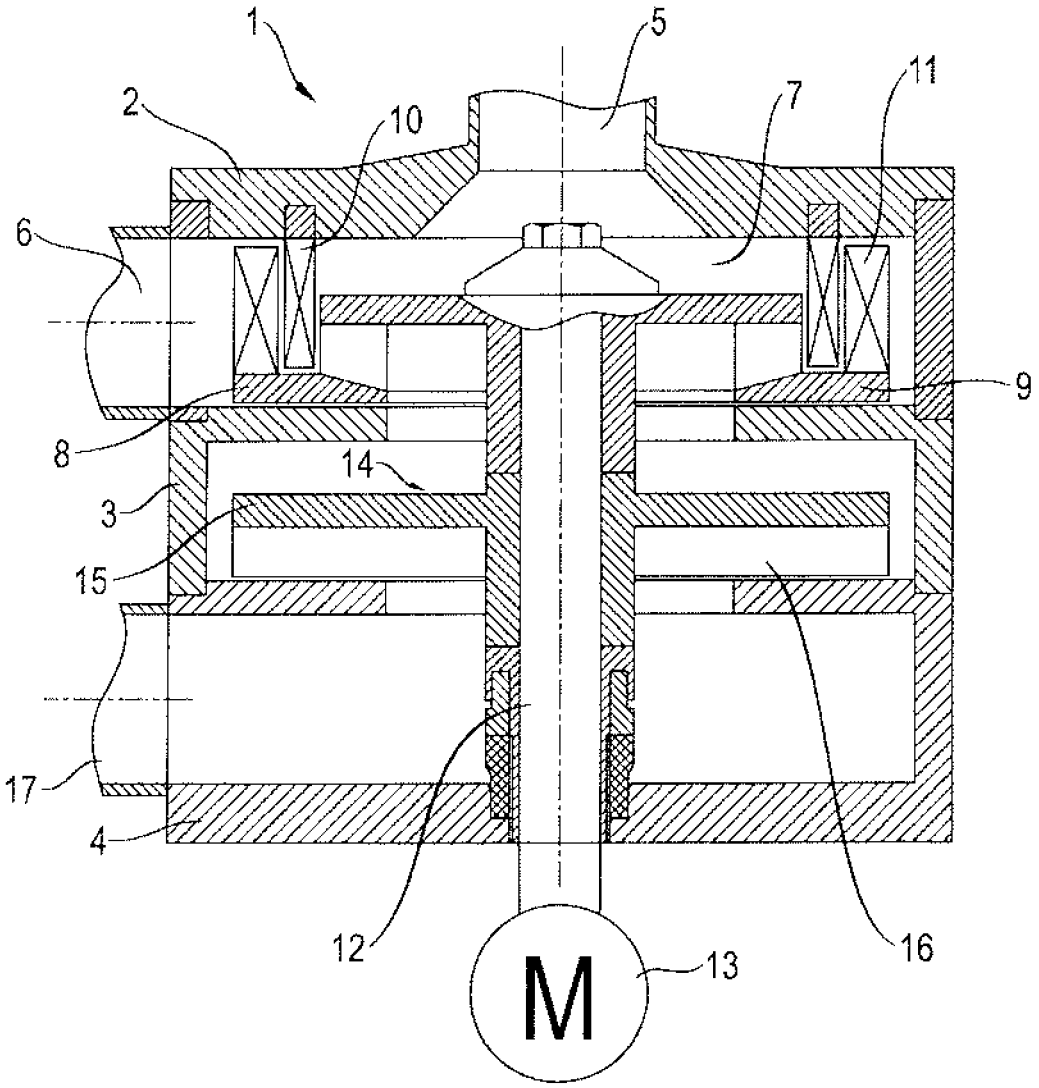
FIG. 1 shows a mixing device according to an embodiment of the invention in cross section.
Figure 2:
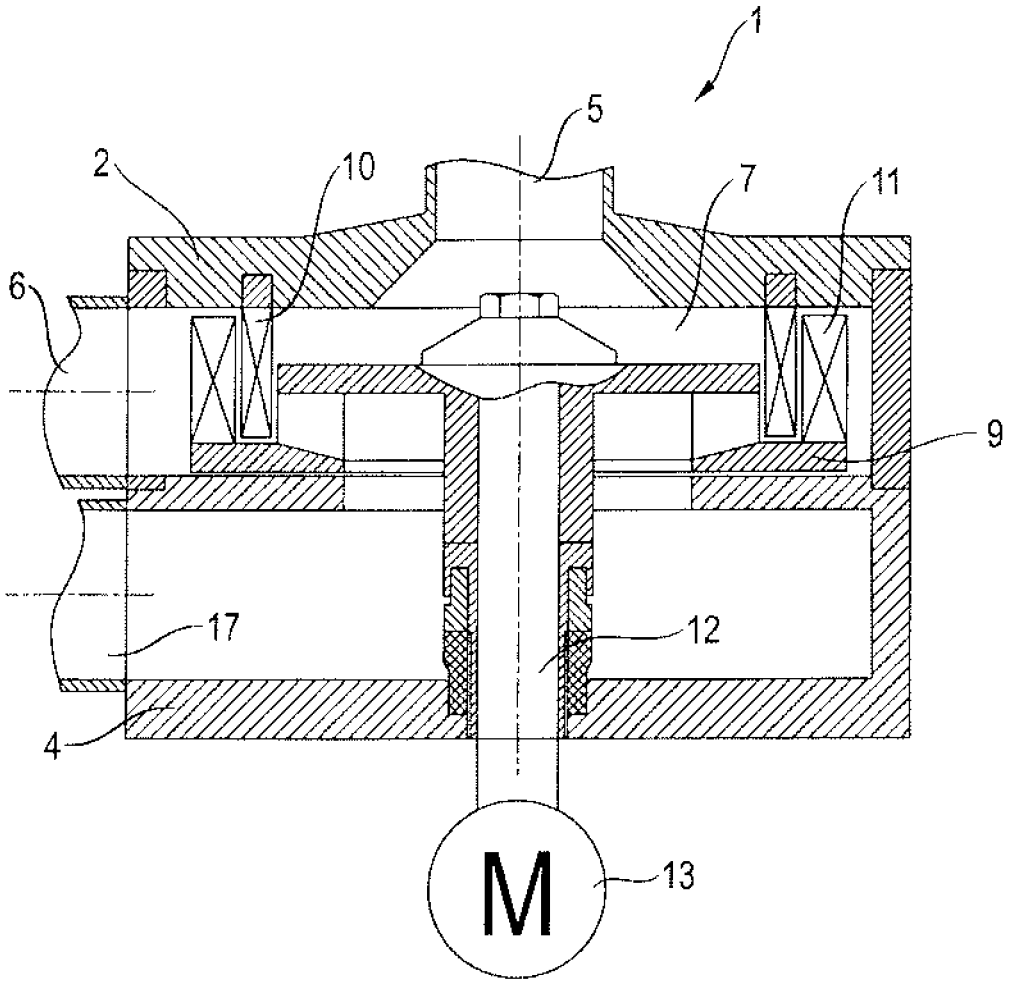
FIG. 2 shows the mixing device from FIG. 1 without delivery module.

FIG. 1 shows a mixing device 1 according to one embodiment of the invention. The mixing device is of modular construction and comprises a mixing module 2, a delivery module 3 and an inlet module 4. The modules 2, 3 and 4 are connected to one another, but can be detached from one another and can be connected to one another in a different way. FIG. 2 shows an alternative, in the case of which provision is not made for a delivery module 3 and the mixing module 2 is directly connected to the inlet module 4.

The mixing module 2 has a vertical central feed duct 5 for feeding a solid as well as a horizontal lateral outlet 6 for the mixture. The feed duct 5 and the outlet 6 empty into a mixing chamber 7, in which a mixing implement 8 is arranged, which is formed by a rotor-stator device 9, 10 comprising a rotor rim 11 and a stator rim. The rotor 9 is connected to a rotating drive shaft 12, which is driven by means of a motor 13.

In the delivery module 3, which is connected to the mixing module 2, provision is made for a delivery pump 14, which is embodied as centrifugal pump, comprising a delivery wheel 15 and a plurality of conveying vanes 16, which are arranged on the delivery wheel 15. The conveying vanes 16 are arranged on the side of the delivery wheel 15, which faces away from the mixing module 2. The delivery wheel 15 as well as the rotor is connected to the drive shaft 12 and is rotated by rotation of the drive shaft 12.

The inlet module 4 is connected on the end of the delivery module 3, which is shown on the bottom in image orientation. The inlet module 4 comprises a horizontal lateral inlet 17 for the liquid.

The inlet 17 is connected to a liquid container, which is not shown. The outlet 6 can also be connected to the liquid container, so that a closed circuit is formed and the mixture can be delivered back into the liquid container and can be fed to the mixing process again.

During operation, i.e. in response to the rotation of the rotor 9 and of the delivery wheel 15, the solid is sucked into the mixing chamber 7 through the feed duct 5. Due to the particle acceleration by means of the rotor 9, an underpressure is in particular created in the mixing chamber 7, which has the effect that powders or granules are sucked through the feed duct 5. The rotor 9 is embodied and arranged in such a way that the solid is initially delivered separately from the liquid and encounters the liquid only in a predetermined area with a high turbulence. The solid is thereby accelerated within the rotor 9 and is finely distributed prior to the dispersion into the liquid due to the volume increase towards the edge area of the rotor 9. The finely distributed solid particles then encounter a liquid jacket comprising a relatively large surface, so that they are dispersed into the liquid in an agglomerate-free manner.

The delivery pump 14 creates an additional suction effect, so that it is ensured that sufficient liquid and solid reach into the mixing chamber 7, even if the liquid has a high viscosity or if the viscosity thereof increases during the mixing process.

Figure 3:
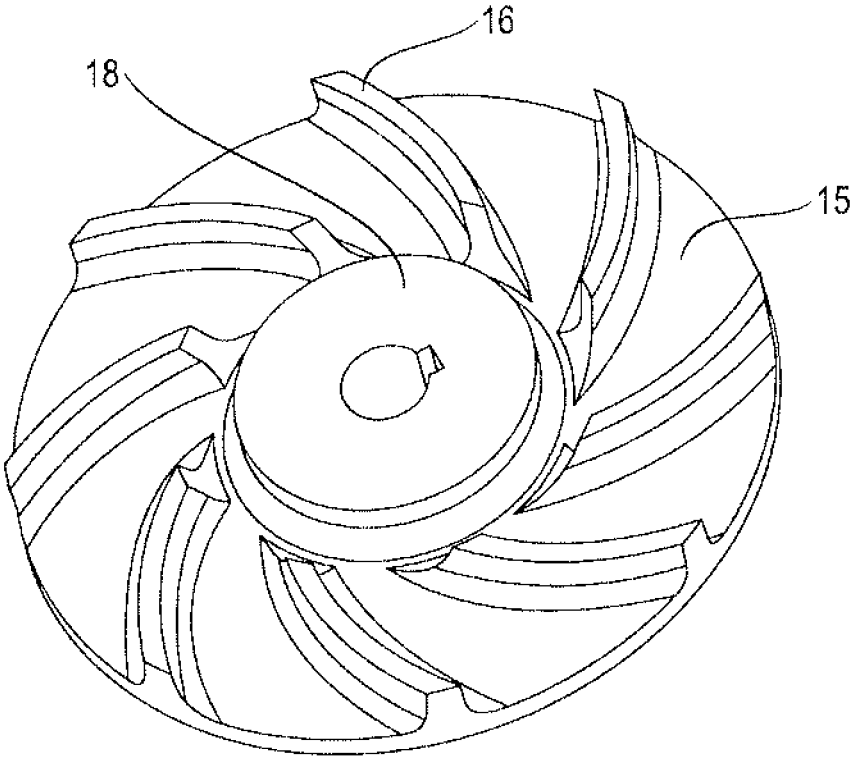
FIG. 3 shows a perspective view of the delivery wheel of the mixing device from FIG. 1.
Figure 4:
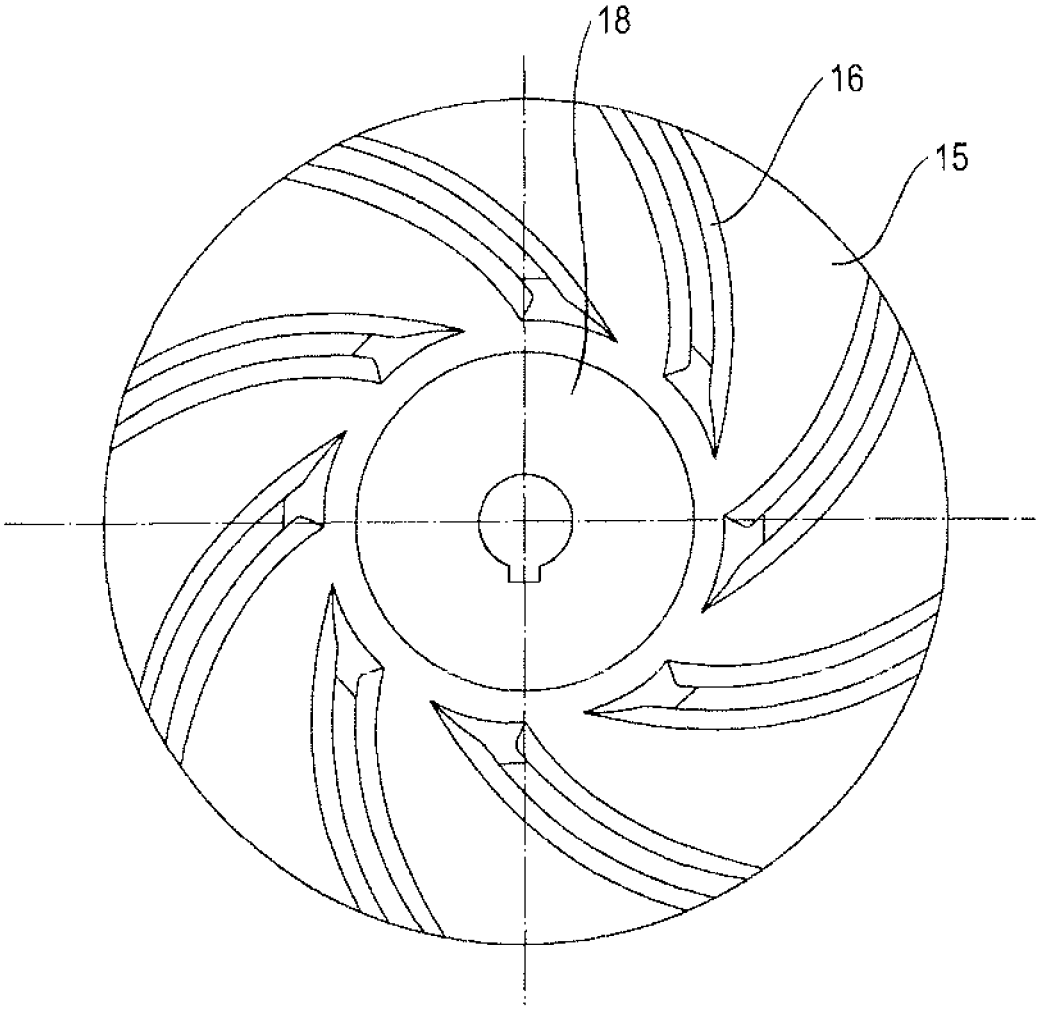
FIG. 4 shows a top view onto the delivery wheel from FIG. 3.

FIGS. 3 and 4 show the delivery wheel 15 according to the embodiment of the invention illustrated in FIG. 1. The delivery wheel 15 has eight conveying vanes 16, each of which have a curvature and extend from the radially outer edge of the delivery wheel in the direction of a hub 18, wherein the radially inner end of the conveying vanes 16 is spaced apart from the hub 18.

Figure 5:
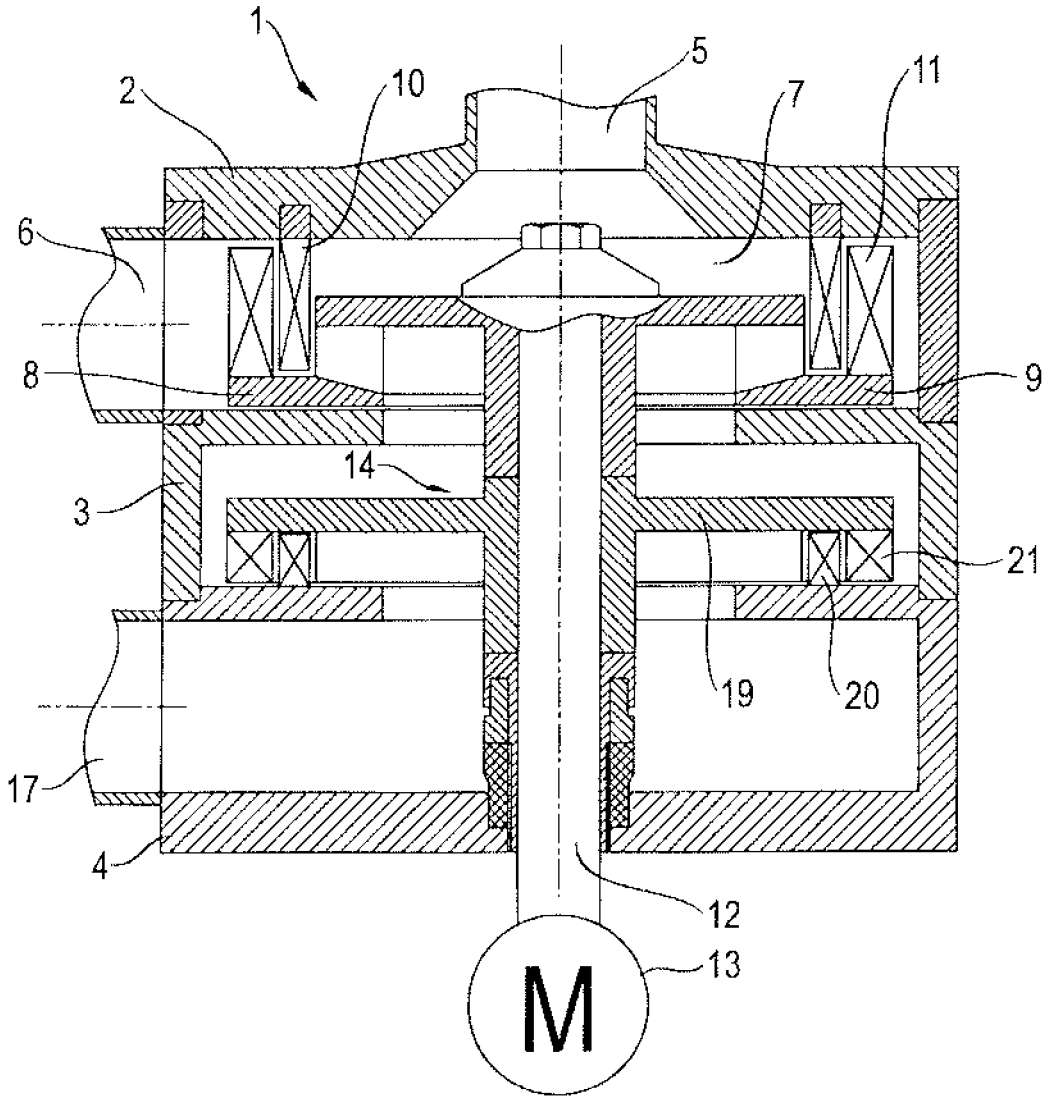
FIG. 5 shows a mixing device according to a further embodiment of the invention in cross section.

FIG. 5 shows a mixing device 1 according to a further embodiment of the invention at hand. The embodiment in FIG. 5 differs from the embodiment in FIG. 1 in that the delivery pump 14 is formed by a rotor/stator device comprising a rotor 19 and a stator 20. The rotor 19 comprises at least one rotor rim 21. A particularly fine dispersion is attained by means of this embodiment. This is in particular the case, when the mixture recirculates, i.e. is fed to the mixing process again.

FIG. 6 shows an embodiment of the invention comprising a further connection 22 between the delivery module 3 and the mixing chamber 7. The further connection runs outside of a housing 23 on the outside thereof, from a horizontally external side of the delivery module 3 to an outside of the mixing module 2. The further connection 22 forms a bypass line for the liquid delivered by the delivery pump 14. The terms further connection and bypass line will be used synonymously hereinafter. A portion of the delivered liquid can bypass the delivery duct along the axis of the delivery pump 14 between the delivery module 3 and the mixing module 2 via the further connection 22 and can reach directly back into the mixing module 2. The further connection 22 is formed by a hose or pipe line. The further connection 22 has an opening 24, which leads into the mixing chamber 7. The opening 24 is located on the side located opposite the mixing implement 8—in the illustrated orientation on the upper side—of the mixing chamber 7, so that the liquid can run into the mixing chamber 7 with the aid of gravity. The opening 24 is formed by means of an annular gap 25. The annular gap 25 surrounds the feed duct 5 concentrically. In this embodiment, the feed duct 5 is aligned with the axis of the mixing implement 8.

FIG. 7 shows an embodiment of the invention comprising an eccentric feed duct 5 and an exterior bypass line 22. The feed duct 5 is arranged so as to be displaced with respect to the axis of the mixing implement 8. The opening 24 of the bypass line 22, which is embodied as annular gap 25, is expanded inside the housing 23 of the mixing device 1 in such a way that the annular gap 25 also runs concentrically around the feed duct 5.

FIG. 8 shows an embodiment of the invention, wherein the further connection 22, which forms the bypass line, inside the housing 23 of the mixing device 1 runs along the delivery direction of the liquid—ascending in the illustrated orientation—from the delivery module 3 to the mixing module 2. The opening 24 is also located completely in the interior of the housing 23 of the mixing device 1. The bypass line 22 is completely integrated into the housing 23 of the mixing device 1 and forms a channel, which is completely surrounded by the housing 23.

FIG. 9 shows an embodiment comprising an eccentric feed duct 5. The feed duct 5 is closed by means of a piston 26. The piston 26 is arranged so as to be capable of being displaced along the feed direction of the solid in the feed duct 5. The piston 26 is flush with the walls of the feed duct 5 and forms a closed hollow space with the housing 23 and the mixing chamber 7. By means of a corresponding integration of the piston 26, the seal of the mixing chamber 7 is embodied in a pressure-resistant manner. Solid to be fed is guided into the mixing chamber 7 by moving the piston 26 along the feed duct 5.

LIST OF REFERENCE NUMERALS

1 mixing device
2 mixing module
3 delivery module
4 inlet module
5 feed duct
6 outlet
7 mixing chamber
8 mixing implement
9 rotor
10 stator
11 rotor rim
12 drive shaft
13 motor
14 delivery pump
15 delivery wheel
16 conveying vane
17 inlet
18 hub
19 rotor
20 stator
21 rotor rim
22 further connection (bypass line)
23 housing of the mixing device
24 opening
25 annular gap
26 piston

The invention claimed is:

1. A mixing device (1) for intermixing powder particles and/or granular particles or a similar free-flowing solid with at least one liquid, the mixing device comprising:

a feed duct (5) for the solid;

an inlet (17) for the liquid;

a mixing chamber (7), wherein the feed duct (5) leads directly into the mixing chamber (7);

at least one mixing implement (8) rotatable about an axis in the mixing chamber (7), wherein the mixing implement (8) is formed by a rotor (9) and a stator (10), the stator (10) surrounding the feed duct (5) in the mixing chamber (7) to bound an inner volume in the mixing chamber (7), the rotor (9) including an upstanding rotor rim (11) positioned radially outwardly from the stator (10) away from the axis, wherein the solid is discharged from the feed duct (5) into the inner volume;

an outlet (6) for a mixture of the solid and the liquid, wherein the outlet (6) is in direct communication with the mixing chamber (7); and a delivery pump (14) arranged between the inlet (17) and the mixing implement (8), wherein the liquid is delivered from the inlet (17) into the inner volume by the delivery pump (14), wherein the solid and the liquid in the inner volume are mixed by the mixing implement (8) with the rotor (9) rotating relative to the stator (10).

2. The mixing device according to claim 1, wherein the outlet (6) is arranged horizontally and the feed duct (5) is arranged vertically.

3. The mixing device (1) according to claim 1, wherein the delivery pump (14) is arranged above the inlet (17) with respect to the delivery direction of the solid.

4. The mixing device (1) according to claim 1, wherein the feed duct (5) is arranged eccentrically with respect to the axis of rotation of the mixing implement (8).

5. The mixing device according to claim 1, wherein the feed duct (5) is selectively closable by means of a seal or a plug or a pressure piston (26), wherein the seal or the plug or the pressure piston (26) is movable in the feed duct (5) along the feed direction of the solid and is flush with the walls of the feed duct (5).

6. The mixing device (1) according to claim 1, wherein a further connection (22) exists between the delivery pump (14) and the mixing chamber (7).

7. The mixing device according to claim 6, wherein the further connection (22) is arranged inside a housing (23) of the mixing device (1).

8. The mixing device (1) according to claim 1, wherein the delivery pump (14) is formed by a centrifugal pump comprising a delivery wheel (15) comprising a plurality of conveying vanes (16).

9. The mixing device (1) according to claim 1, wherein the rotor (9) is arranged between the stator (10) and the delivery pump (14).

10. The mixing device (1) according to claim 1, wherein the delivery pump (14) is arranged on the same drive shaft (12) as the mixing implement (8).

11. The mixing device (1) according to claim 1, wherein the outlet (6) empties into an outline line, which leads back into a container for the liquid, which is connected to the inlet (17) via a feed line.

12. The mixing device (1) according to claim 1, wherein the mixing device is embodied in a modular manner, with a mixing module (2) comprising the mixing implement (8), a delivery module (3) comprising the delivery pump (14), and an inlet module (4) comprising the inlet (17), wherein the delivery module can be arranged between the mixing module and the inlet module.

13. The mixing device (1) according to claim 7, wherein the further connection (22) is a connecting channel embodied in the housing (23).

14. The mixing device (1) according to claim 6, wherein the further connection (22) is formed by at least one bore.

15. The mixing device (1) according to claim 6, wherein the further connection (22) is formed by at least one nozzle.

16. The mixing device (1) according to claim 8, wherein the plurality of conveying vanes (16) includes four conveying vanes.

17. The mixing device (1) according to claim 8, wherein the plurality of conveying vanes (16) includes eight conveying vanes.

18. The mixing device (1) according to claim 8, wherein the conveying vanes (16) are curved.

19. The mixing device (1) according to claim 8, wherein the conveying vanes (16) are arranged on the side of the delivery pump (14) facing away from the mixing implement (8).

20. The mixing device (1) according to claim 6, wherein the further connection (22) is formed by a pipe or a hose line on the outside of a housing (23) of the mixing device (1), and has an opening (24) into the mixing chamber (7).

21. The mixing device (1) according to claim 20, wherein the opening (24) of the further connection (22) is formed by an annular gap (25).

22. The mixing device (1) according to claim 21, wherein the annular gap (25) is arranged above the mixing chamber (7) with respect to the delivery direction of the liquid and around the feed duct (5).

23. The mixing device (1) according to claim 1, wherein a radial gap is defined between the stator (10) and the rotor rim (11), wherein first portions of the rotor (9) are axially spaced from the stator (10), in a direction parallel to the axis, to define an axial spacing between the first portions of the rotor (9) and the stator (10), and, wherein the radial gap is in communication with the axial spacing.

24. The mixing device (1) according to claim 1, wherein the inlet (17) is arranged horizontally and the feed duct (5) is arranged vertically.

* * * * *